US010882670B2

(12) United States Patent
Kim

(10) Patent No.: US 10,882,670 B2
(45) Date of Patent: Jan. 5, 2021

(54) POWDER-TYPE HAIR THICKENING AGENT STORAGE CONTAINER HAVING PLURALITY OF SPURTING HOLES

(71) Applicants: Moon Hee Kim, Bucheon-si (KR); BANANA FACTORY CO., LTD., Seoul (KR)

(72) Inventor: Moon Hee Kim, Bucheon-si (KR)

(73) Assignees: Moon Hee Kim, Bucheon-si (KR); BANANA FACTORY CO., LTD., Seoul (KR)

( * ) Notice: Subject to any disclaimer, the term of this patent is extended or adjusted under 35 U.S.C. 154(b) by 0 days.

(21) Appl. No.: 16/624,291

(22) PCT Filed: Apr. 18, 2018

(86) PCT No.: PCT/KR2018/004506
§ 371 (c)(1),
(2) Date: Dec. 18, 2019

(87) PCT Pub. No.: WO2019/054596
PCT Pub. Date: Mar. 21, 2019

(65) Prior Publication Data

US 2020/0122902 A1 Apr. 23, 2020

(30) Foreign Application Priority Data

Sep. 14, 2017 (KR) ..... 20-2017-0004850 U

(51) Int. Cl.
*B65D 47/12* (2006.01)
*B65D 81/26* (2006.01)
*B65D 83/06* (2006.01)

(52) U.S. Cl.
CPC ..... *B65D 47/123* (2013.01); *B65D 81/268* (2013.01); *B65D 83/06* (2013.01)

(58) Field of Classification Search
CPC ..... B65D 47/123; B65D 81/268; B65D 83/06
See application file for complete search history.

(56) References Cited

U.S. PATENT DOCUMENTS 4,938,389 A * 7/1990 Rossi ..... A61F 9/0008 210/321.64
5,914,045 A * 6/1999 Palmer ..... C02F 1/003 210/136

(Continued)

FOREIGN PATENT DOCUMENTS

JP 2005-306473 A 11/2005
KR 20-0383738 Y1 5/2005

(Continued)

OTHER PUBLICATIONS

International Search Report for PCT/KR2018/004506 dated Jul. 31, 2018 from Korean Intellectual Property Office.

*Primary Examiner* — Jeremy Carroll
(74) *Attorney, Agent, or Firm* — Revolution IP, PLLC

(57) ABSTRACT

The present invention relates to a powder-type hair thickening agent storage container having a plurality of spurting holes, and to a powder-type hair thickening agent storage container having a plurality of spurting holes, the storage container having a cylindrical protrusion part, which protrudes from an upper surface thereof to spurt a powder-type hair thickening agent to an outside, and including: a barrel-shaped container part having the powder-type hair thickening agent stored therein; a packing part detachably coupled to an inside of the protrusion part, and having a discharge hole such that the powder-type hair thickening agent is spurted to the outside; and a cap part coupled to the protrusion part so as to encompass the same, and allowing the spurting amount of the powder-type hair thickening agent to be adjusted through the discharge hole.

4 Claims, 8 Drawing Sheets

(56) References Cited

U.S. PATENT DOCUMENTS

| | | | | |
|---|---|---|---|---|
| 7,993,518 | B2 * | 8/2011 | Shani | B01D 61/18 210/236 |
| 10,570,023 | B2 * | 2/2020 | Phan | C02F 1/003 |

FOREIGN PATENT DOCUMENTS

| | | | |
|---|---|---|---|
| KR | 2012-144277 | A | 8/2012 |
| KR | 20-2013-0007402 | U | 12/2013 |
| KR | 10-1709745 | B1 | 2/2017 |

* cited by examiner

POWDER-TYPE HAIR THICKENING AGENT STORAGE CONTAINER HAVING PLURALITY OF SPURTING HOLES

TECHNICAL FIELD

The present invention relates to a powder-type hair thickening agent storage container having a plurality of spurting holes. More particularly, the present invention relates to a powder-type hair thickening agent storage container having a plurality of spurting holes, the container being configured to selectively open a cap part having a spurting hole with a wide spurt area or a cap part having a spurting hole with a narrow spurt area according to an area of a region onto which a powder-type hair thickening agent, commonly called "black hair powder", stored in a container body is sprayed, thus guaranteeing convenient use.

BACKGROUND ART

Generally, a powder-type hair thickening agent, namely, black hair powder is known as a black solid powdery substance that is sprayed onto the hair of a person with less hair or thinner hair more conveniently than the person wears a wig. Recently, the black hair powder has become appealing to users with severe hair loss due to its convenient use.

Furthermore, the black hair powder is fine powder that is mostly made of fiber or charcoal, is harmless to a human body, and is most preferred by people having no hair in the crown of the head. The black hair powder is usually used by people who have hair of five to ten centimeters but have thinner hair rather than people having no hair.

Generally, hair thickening hair products composed of the black hair powder may be classified into a discharge type using a filter and a spray type depending on a using method. A conventional black hair powder storage container includes a barrel-shaped container body storing a proper amount of black hair powder, and a lid opening or closing a spout of the container body. The spout of the container body is opened or closed by the lid using a threaded part formed on an outer circumference of the spout of the container body and a threaded part formed on an inner circumference of the lid.

Furthermore, the spout of the container body is closed by a mesh filter, so that the black hair powder in the container body is discharged through the mesh filter, thus allowing the black hair powder to be dispersed and uniformly spread onto a desired place without agglomerating.

However, the conventional powder-type hair thickening agent storage container is configured such that the container body is turned upside down as shown in FIG. 2 and then is shaken in the direction shown by the arrow, thus sprinkling the black hair powder in the container body onto the hair. Thus, it is slightly inconvenient to use the conventional storage container. Furthermore, since the spout through which the black hair powder is discharged is formed to have a wide area, the black hair powder may be dispersed more widely than necessary and then discharged. Hence, it is difficult to precisely spray a proper amount of black hair powder onto a desired region, so that the powder may be excessively discharged to even an unnecessary peripheral region around the desired region. Consequently, the black hair powder may not only be wasted but also settle in the face, shoulders, clothes, or a washbasin, thus causing sanitary or visual discomfort.

As the related art for solving the above-described problems, Korean U.M. registration No. 20-0453435 has been proposed, which is entitled to "Powder-type hair thickening agent storage container".

According to the related art, the black hair powder in a container body is spurted out from a spurting hole by air pressure generated in the container body by lightly pressing the container body, and the area of the spurting hole through which the black hair powder is spurted is minimized, thus allowing a proper amount of black hair powder to be precisely sprayed onto a desired region. Therefore, very convenient use is ensured, the black hair powder can be prevented from being sprayed onto an unnecessary region, and the black hair powder is not discharged when the lid is closed, thus preventing the loss of the black hair powder.

The related art is advantageous in that the area of the hole for spurting the black hair powder is minimized, so that the black hair powder can be precisely sprayed onto a desired region. However, when one desires to spray the black hair powder onto a large area, the black hair powder should be spurted by pressing the container body several times, thus causing inconvenience to a user. Further, a direction in which the black hair powder is spurted through the spurting hole is the same as a longitudinal direction (height direction) from the top to the bottom of the container body. Thus, especially when one desires to spray the black hair powder onto the crown of the head, the black hair powder is spurted with a user obliquely holding the container body. In this case, the black hair powder is obliquely spurted, so that it is impossible to precisely and uniformly spray the powder onto the crown of the head. Therefore, since the container body should be held to be vertically set up on the crown of the head when a user spray the black hair powder onto the crown of the head, it is inconvenient to use due to an unstable posture.

DISCLOSURE

Technical Problem

The present invention has been made to solve the above-mentioned problems and difficulties and relates to a novel structure of a powder-type hair thickening agent storage container having a plurality of spurting holes, the container being configured to allow a user to select a cap part having a spurting hole for spurting a powder-type hair thickening agent to a wide area or a cap part having a spurting hole for spurting the hair thickening agent to a narrow area, according to an area of a region onto which the hair thickening agent is to be sprayed, thus being very convenient to use.

Furthermore, the present invention is to provide a powder-type hair thickening agent storage container having a plurality of spurting holes, which allows a user to easily hold a container part and further increases internal air pressure generated when the container part is pressed, thus allowing the powder-type hair thickening agent to be more smoothly spurted.

Technical Solution

In order to accomplish the above object, the present invention provides a powder-type hair thickening agent storage container having a plurality of spurting holes, the storage container having a cylindrical protrusion part which protrudes from an upper surface thereof to spurt a powder-type hair thickening agent to an outside, the storage container including:

a barrel-shaped container part storing the powder-type hair thickening agent therein;

a packing part detachably coupled to an inside of the protrusion part and having a discharge hole such that the powder-type hair thickening agent is spurted to the outside; and a cap part coupled to the protrusion part to surround the protrusion part, and adjusting a spurting amount of the powder-type hair thickening agent through the discharge hole.

In the powder-type hair thickening agent storage container having the plurality of spurting holes according to an embodiment of the invention, the packing part may include a column-shaped body part having a diameter corresponding to the inside of the protrusion part; a step part protruding along an outer circumference of a top of the body part to be put on an upper end of the protrusion part; a plurality of ring parts formed along an outer circumference of the body part to be in close contact with an inner circumference of the protrusion part; a pair of mesh filters coupled to upper and lower portions in the discharge hole; at least one discharge pipe vertically disposed in the discharge hole; and a thin film surrounding the discharge pipe.

In the powder-type hair thickening agent storage container having the plurality of spurting holes according to an embodiment of the invention, the cap part may include a body part having a shape of a pipe that is opened at a bottom thereof and is closed at a top thereof to correspond to a diameter of the outer circumference of the protrusion part; a first spurting hole having a same size as a diameter of the discharge hole and protruding from a surface of the body part to communicate with the discharge hole; a mesh net coupled to another surface of the body part to disperse the powder-type hair thickening agent spurted to the first spurting hole; a main stopper detachably coupled to cover the body part; and a sub stopper installed inside the main stopper, and having a second spurting hole formed to have a diameter smaller than an inner diameter of the first spurting hole and to communicate with the first spurting hole, wherein the main stopper may be detached or attached to open or close the second spurting hole.

In the powder-type hair thickening agent storage container having the plurality of spurting holes according to an embodiment of the invention, the cap part may include a connecting part formed on a side of each of the body part and the main stopper to integrally connect the body part with the main stopper; and a hinge part formed on a surface of the body part to rotate the sub stopper.

In the powder-type hair thickening agent storage container having the plurality of spurting holes according to an embodiment of the invention, the container part may include an air capsule therein to remove moisture of the powder-type hair thickening agent.

Advantageous Effects

According to an embodiment of the present invention, a plurality of cap parts having different spurting holes of different diameters to spurt a powder-type hair thickening agent to the outside is provided. As one of the spurting holes has a large diameter and the other has a small diameter, the spurting hole can be selected according to an area of a region onto which a powder-type hair thickening agent is to be sprayed, thus reducing the waste of the powder-type hair thickening agent and guaranteeing a convenient use.

BEST MODE

Figure 1:
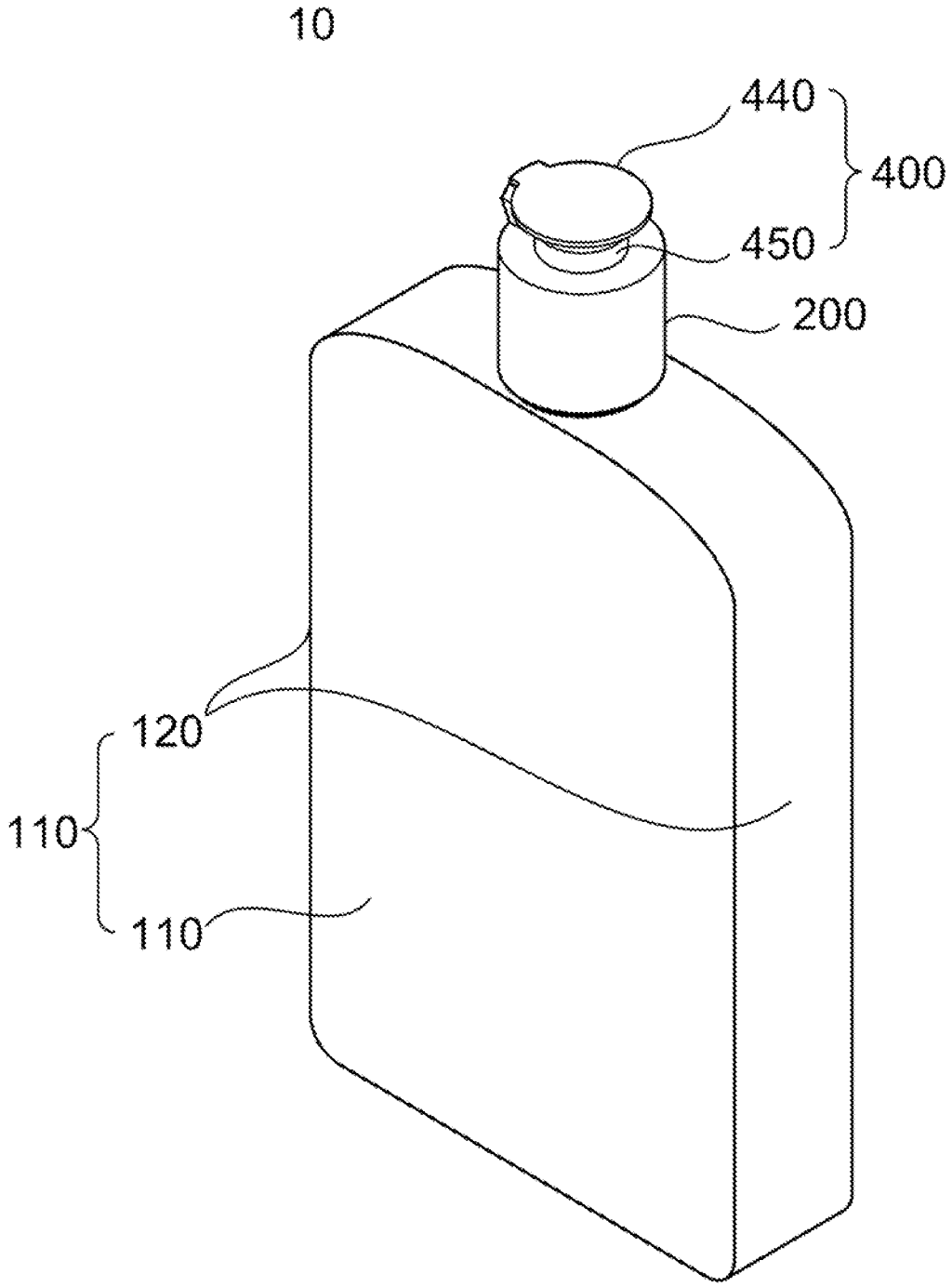
FIG. 1 is a perspective view showing a powder-type hair thickening agent storage container having a plurality of spurting holes according to an embodiment of the present invention.

Hereinafter, a preferred embodiment that can be easily carried out by those skilled in the art will be described in detail with reference to the accompanying drawings. In describing the operation principle of the preferred embodiment of the present invention in detail, if it is determined that the detailed description of a known function or configuration unnecessarily makes the subject matter of the invention obscure, the detailed description thereof will be omitted herein.

Furthermore, the same reference numerals are used for components having similar functions and operations throughout the drawings.

In addition, the expression "a first part is connected to a second part" includes a case where the first part is directly connected to the second part as well as a case where the first part is indirectly connected to the second part with a third part intervening therebetween. Moreover, the expression "a component is included" means that another component may be further included unless otherwise specified.

Hereinafter, a powder-type hair thickening agent storage container having a plurality of spurting holes according to the preferred embodiment of the present invention will be described in detail with reference to the accompanying drawings.

Figure 2:
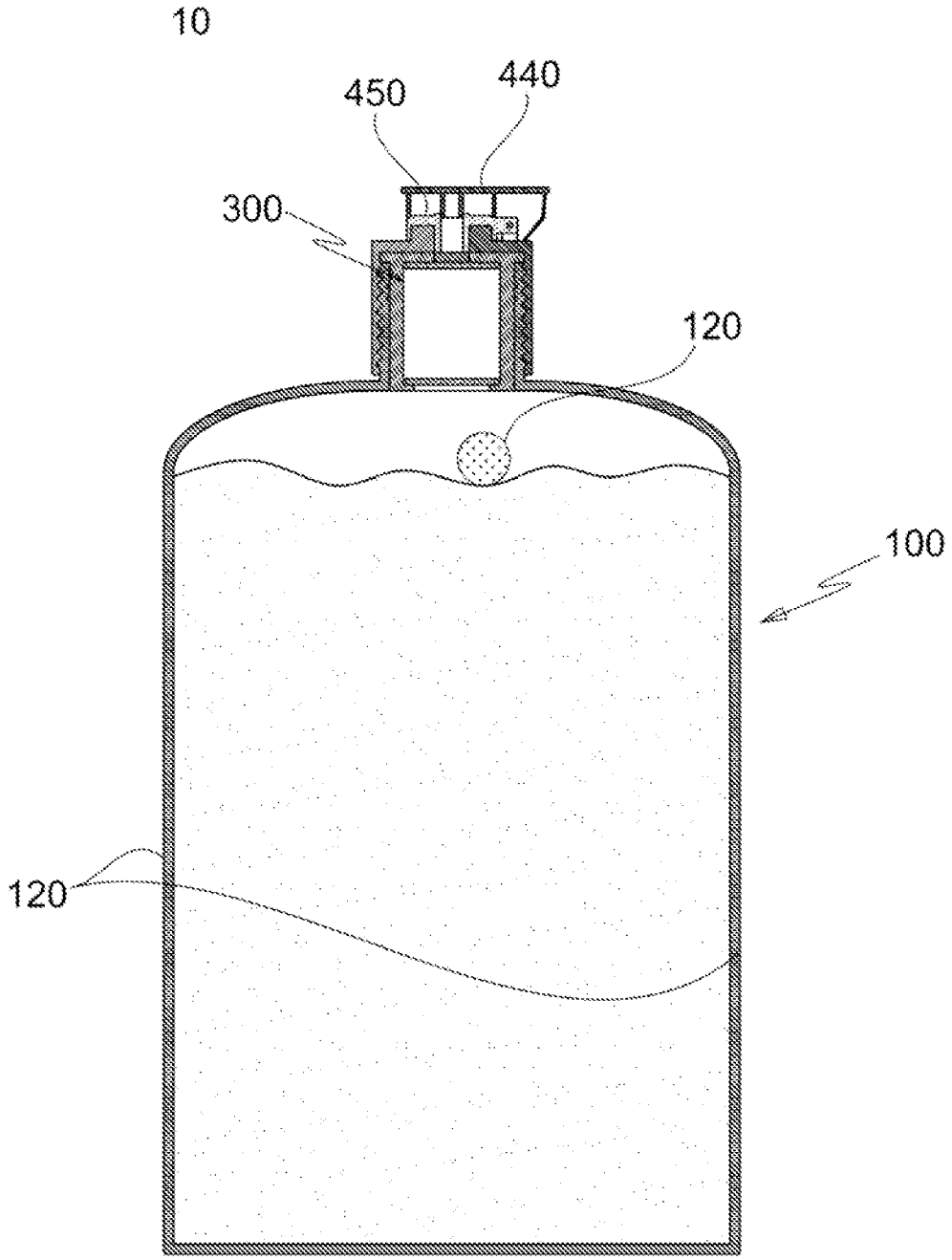
FIG. 2 is a sectional view showing a section of the container of FIG. 1.
Figure 3:
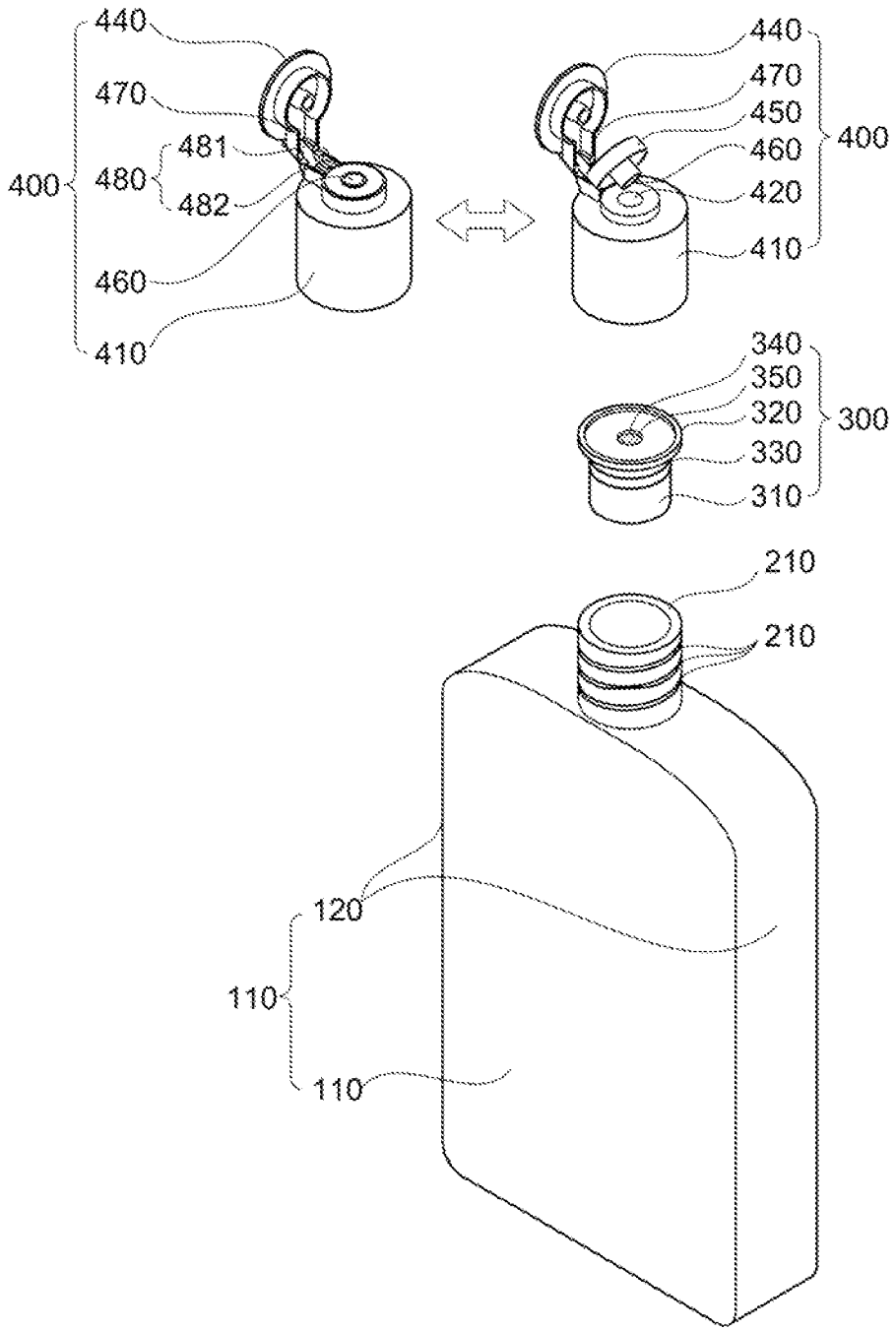
FIG. 3 is an exploded perspective view showing the container of FIG. 1.
Figure 4:
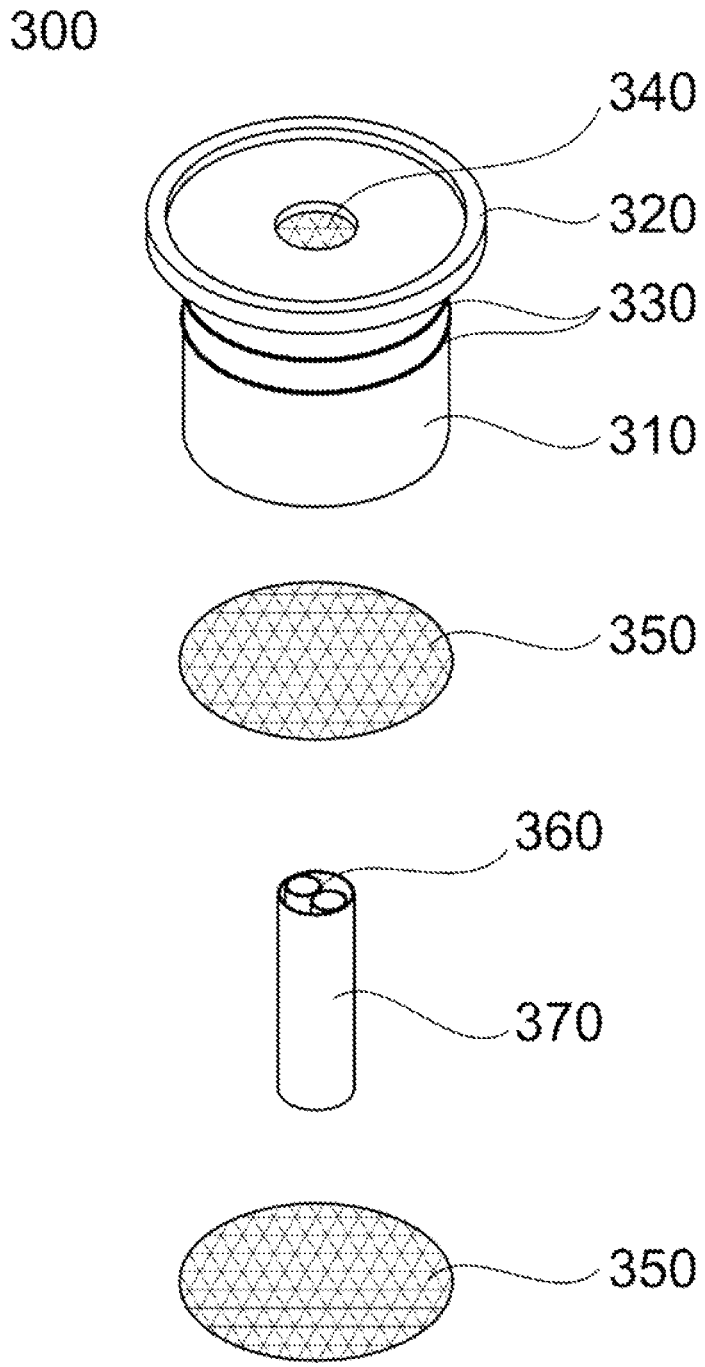
FIG. 4 is an exploded perspective view showing a packing part of the powder-type hair thickening agent storage container having the plurality of spurting holes according to the embodiment of the present invention.
Figure 5:
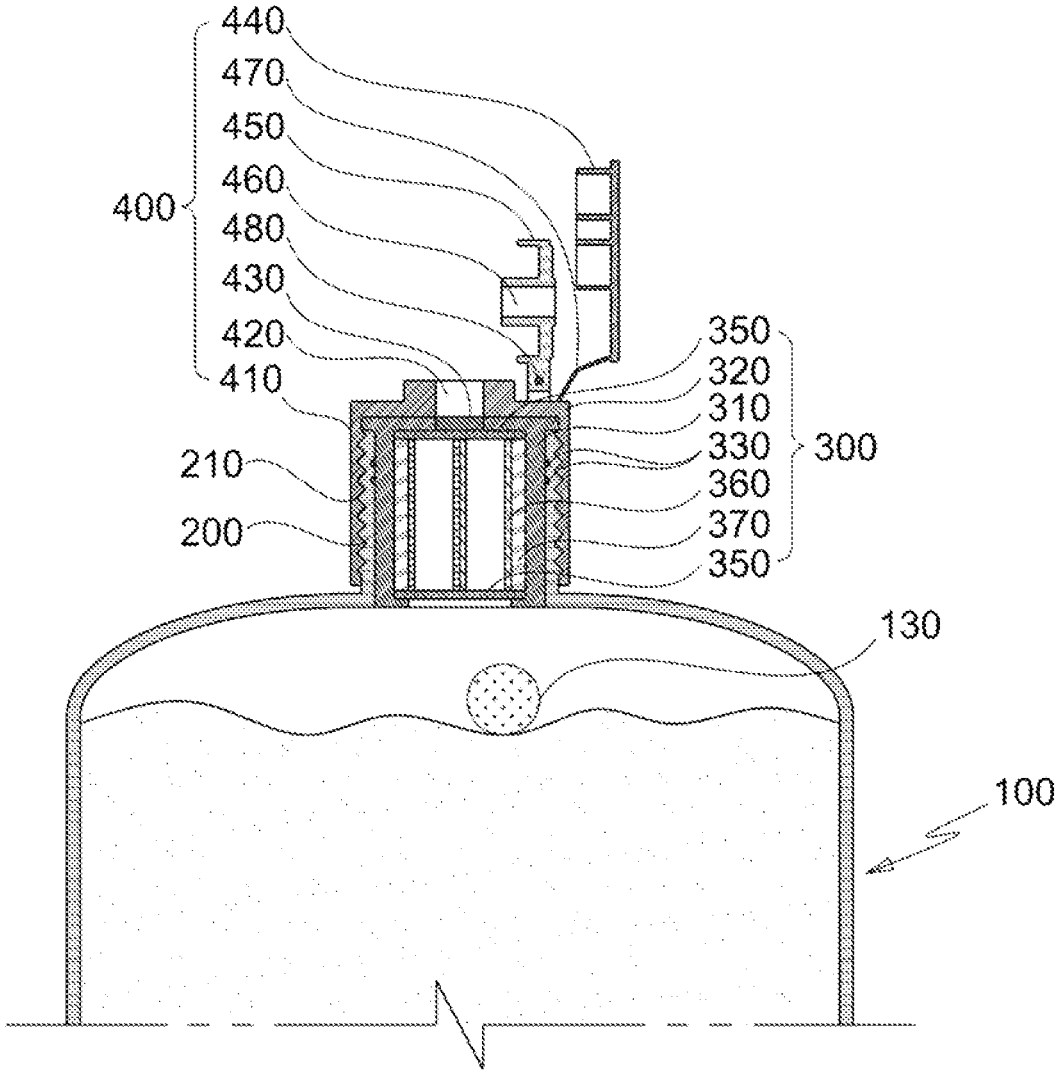
FIGS. 5 and 6 are views showing the use state of a first spurting hole.
Figure 6:
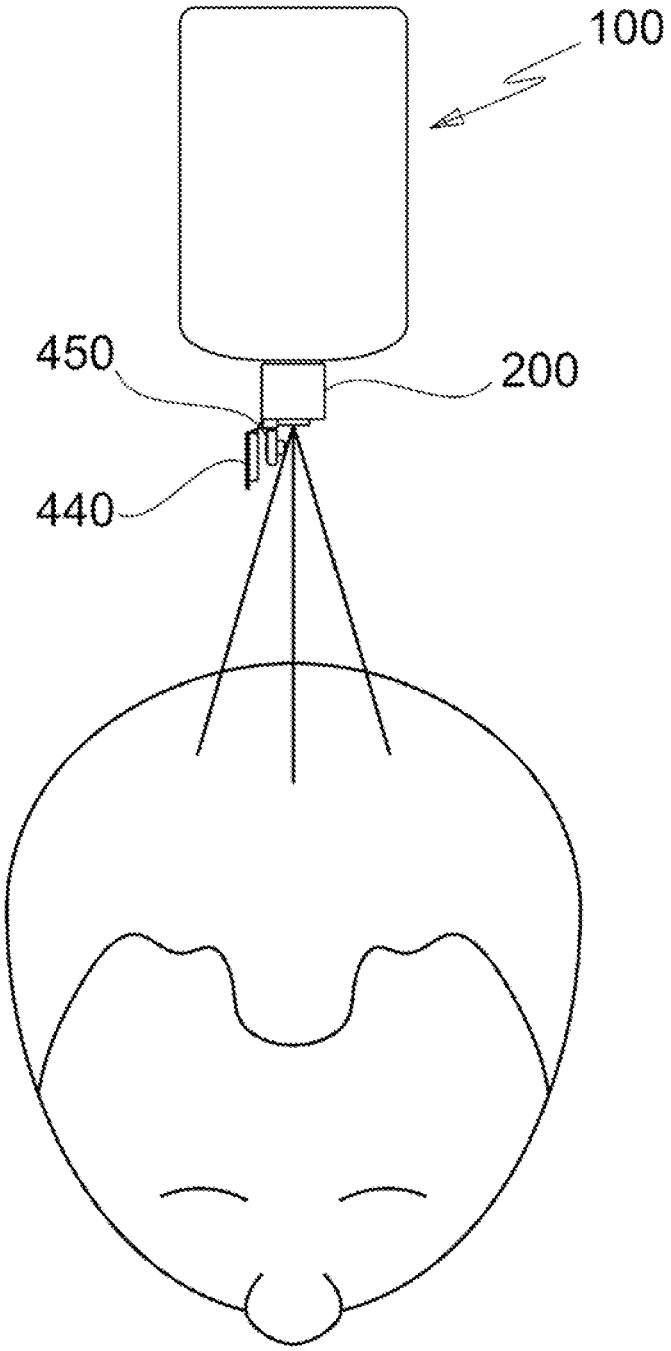
Figure 7:
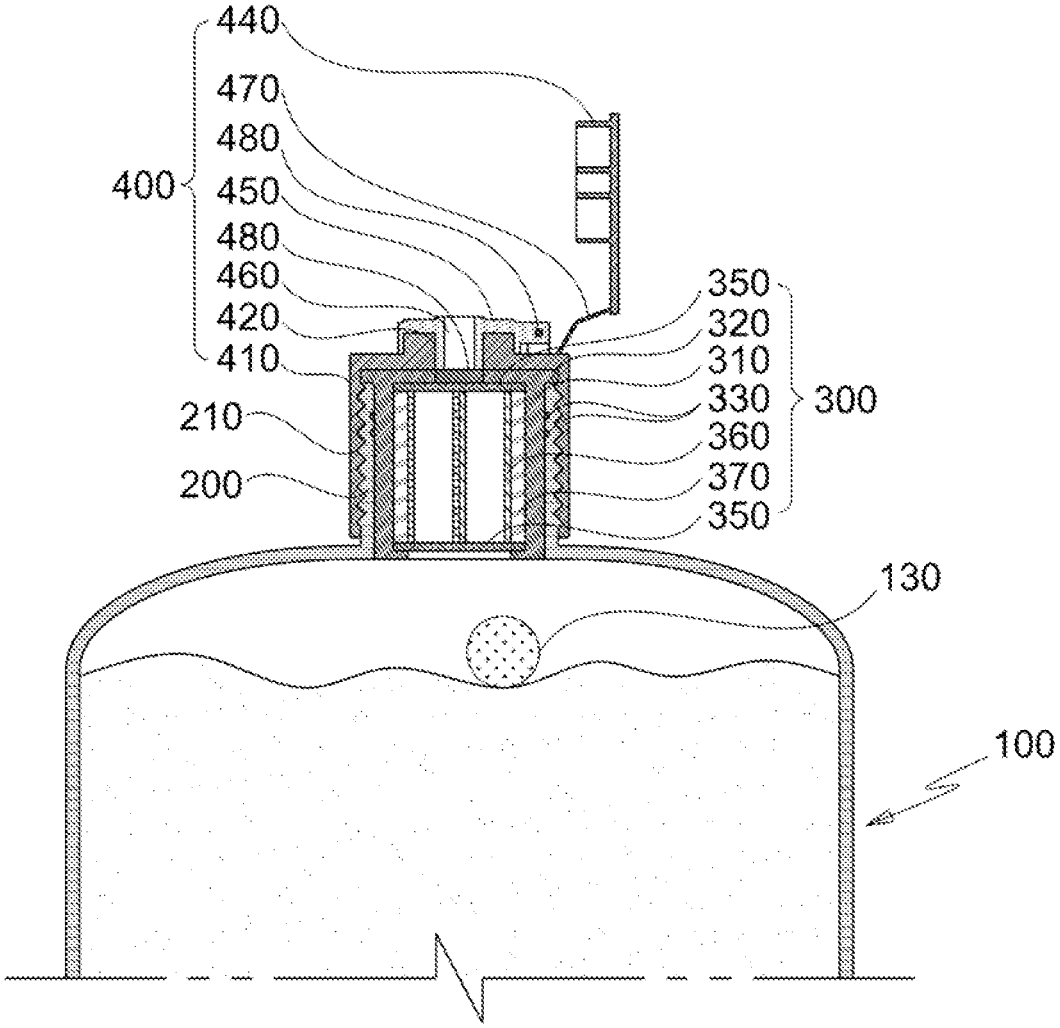
FIGS. 7 and 8 are views showing the use state of a second spurting hole.
Figure 8:
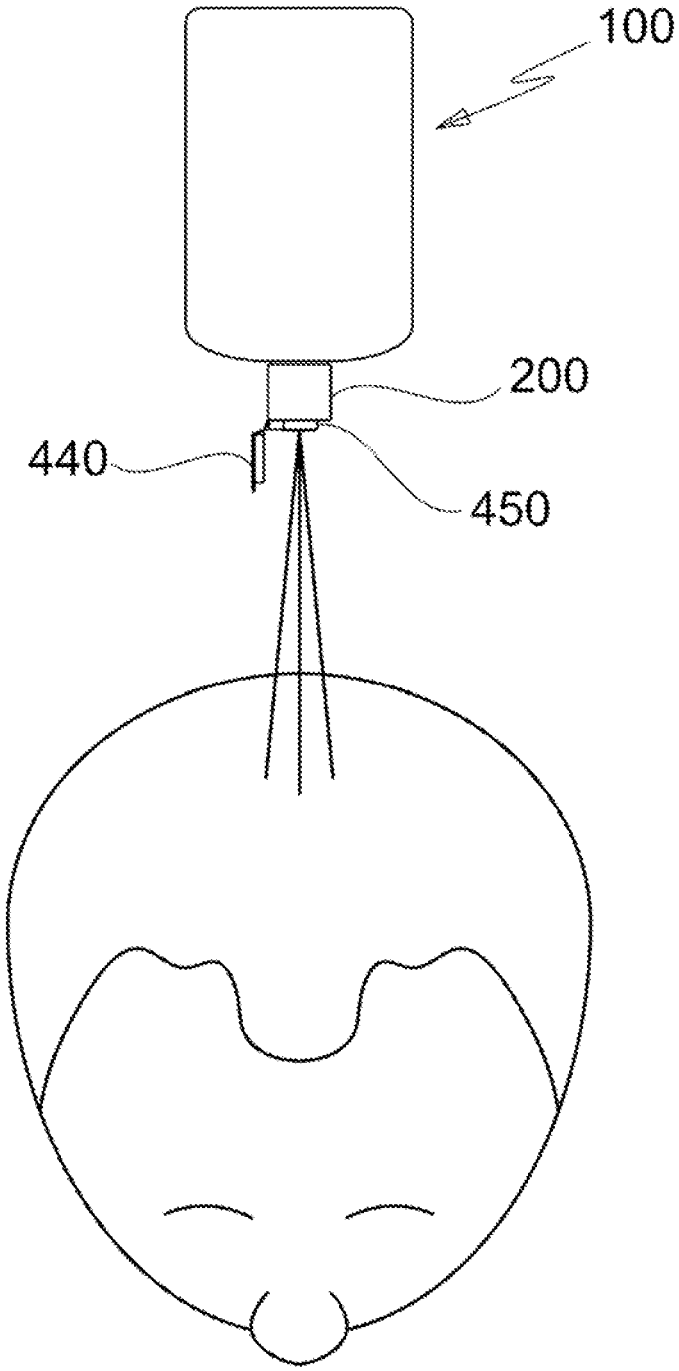

FIG. 1 is a perspective view showing a powder-type hair thickening agent storage container having a plurality of spurting holes according to an embodiment of the present invention, FIG. 2 is a sectional view showing a section of the container of FIG. 1, FIG. 3 is an exploded perspective view showing the container of FIG. 1, FIG. 4 is an exploded perspective view showing a packing part of the powder-type hair thickening agent storage container having the plurality of spurting holes according to the embodiment of the present invention, FIGS. 5 and 6 are views showing the use state of a first spurting hole, and FIGS. 7 and 8 are views showing the use state of a second spurting hole.

As shown in FIGS. 1 to 3, the powder-type hair thickening agent storage container 10 having the plurality of spurting holes according to the embodiment of the present invention includes a container part 100, a protrusion part 200, a packing part 300, and a cap part 400.

In detail, the powder-type hair thickening agent storage container 10 having the plurality of spurting holes includes the cylindrical protrusion part 200 which protrudes from an upper surface thereof to spurt a powder-type hair thickening agent to an outside, and also includes the barrel-shaped container part 100 that stores the powder-type hair thickening agent therein, the packing part 300 that is detachably coupled to an inside of the protrusion part and has a discharge hole 340 such that the powder-type hair thickening agent is spurted to the outside, and a cap part 400 that is coupled to the protrusion part so as to surround the protrusion part and adjusts the spurting amount of the powder-type hair thickening agent through the discharge hole.

Referring to FIGS. 1 and 2, the container part 100 may be the shape of the barrel to store the powder-type hair thickening agent therein, and be made of a soft synthetic resin material having elasticity. The container part 100 may have an inclined surface that is inclined towards the protrusion part 200 that will be described later. Such an inclined surface makes it easy to spurt the powder-type hair thickening agent after the powder-type hair thickening agent stored in the container part 100 is collected towards the protrusion part 200.

Furthermore, the container part 100 is formed flat so that it is easy for a user to hold while the powder-type hair thickening agent is spurted. Preferably, both left and right side surfaces 120 are formed longer than pressing surfaces 110 from the protrusion part 200. The pressing surfaces are provided on front and rear sides of the container part that are pressed by the fingers when a user holds the container part 100.

The protrusion part 200 protrudes from the upper surface of the container part 100, and is a part through which the powder-type hair thickening agent stored in the container part 100 is discharged. Such a protrusion part 200 has a predetermined diameter, and protrudes in the shape of a tube to communicate with the container part 100. An external threaded part 210 may be formed on an outer circumference of the protrusion part 200 so that the protrusion part 200 is coupled to the cap part 400 that will be described later.

As shown in FIGS. 3 and 4, the packing part 300 is detachably coupled to the inside of the protrusion part 200, and has the discharge hole 340 formed to spurt the powder-type hair thickening agent to the outside. To this end, the packing part 300 includes a body part 310, a step part 320, a ring part 330, a pair of mesh filters 350, a discharge pipe 360, and a thin film 370.

The body part 310 may have the shape of a column that has a diameter corresponding to the inside of the protrusion part 200. Such a body part 310 is made of rubber or silicone and is coupled to the inside of the protrusion part 200 to seal the inside of the protrusion part 200.

Preferably, the body part 310 is formed to have a height corresponding to that of the protrusion part 200. Thus, in the case of discharging the powder-type hair thickening agent stored in the container part 100, the hair thickening agent may be smoothly introduced into the body part 210.

The step part 320 protrudes along an outer circumference of a top of the body part 310 to be put on an upper end of the protrusion part 200. That is, when the body part 310 is inserted into the protrusion part 200, the step part 320 is seated on the upper end of the protrusion part 200. Further, the body part may be separated from the protrusion part 200 by holding the step part 320 and pushing it in a direction away from the protrusion part 200.

A plurality of ring parts 330 may be formed along the outer circumference of the body part 310 to be in close contact with the inner circumference of the protrusion part 200. Such a ring part 330 causes the outer circumference of the body part 310 to be in close contact with the inner circumference of the protrusion part 200, thus defining a sealed space. Further, a coupling force between the protrusion part 200 and the packing part 300 is increased by the ring part 330.

The discharge hole 340 is used to spurt the powder-type hair thickening agent to the outside, and has the shape of a hole passing through the center of the packing part 300. Such a discharge hole 340 is a spurting hole that communicates with a first spurting hole 420 which will be described later to spurt the powder-type hair thickening agent to a desired region.

As such, the packing part 300 is formed such that the discharge hole 340 has a smaller diameter as compared to a case where the entire opening of the protrusion part 200 is a spurt diameter. Thus, in order to prevent the flow of the powder-type hair thickening agent stored in the container part 100 from being blocked due to a bottleneck, one pair of mesh filters 350, the discharge pipe 360, and the thin film 370 are provided, which will be described below.

The pair of mesh filters 350 are coupled to upper and lower portions in the discharge hole 340 to close the upper and lower portions of the discharge hole 340. The mesh filters serve to disperse the powder-type hair thickening agent spurted through the discharge hole 340 and thereby uniformly spray the thickening agent.

At least one discharge pipe 360 is vertically disposed in the discharge hole 340. Preferably, a plurality of discharge pipes 360 each having the shape of a pipe that is smaller in diameter than the discharge hole 340 are arranged.

In detail, as shown in FIG. 4, two discharge pipes 360 are vertically disposed in the discharge hole 340. Further, the pair of mesh filters 350 provided on the upper and lower portions of the discharge pipe 360 allows the powder-type hair thickening agent to be dispersed and introduced into the discharge pipe 360. The discharge pipes 360 serve to minimize the blockage when the powder-type hair thickening agent is dispersed by one pair of mesh filters 350 and then is introduced into the discharge pipe 360, and to prevent the bottleneck caused by the powder-type hair thickening agent collected in the protrusion part 200. The mesh filter coupled to the upper portion of the discharge hole 340 disperses the powder-type hair thickening agent spurted through the discharge pipes 360 again, thus preventing the powder-type hair thickening agent from agglomerating.

The thin film 370 is a film that surrounds the discharge pipes 360, and serves to prevent the discharge pipes 360 from being moved or shaken in the discharge hole 340.

Such a packing part 300 serves to spurt the powder-type hair thickening agent stored in the container part 100, and is detachably coupled to the protrusion part 200, thus facilitating replacement.

As shown in FIGS. 2 and 3, the cap part 400 is coupled to surround the protrusion part 200, and adjusts the spurting amount of the powder-type hair thickening agent through the discharge hole 340. To this end, the cap part 400 includes a body part 410, a first spurting hole 420, a mesh net 430, a main stopper 440, and a sub stopper 450.

First, the body part 410 has the shape of a pipe that is opened at a bottom thereof and is closed at a top thereof to correspond to the diameter of the outer circumference of the protrusion part 200. In order to couple with the protrusion part 200, an internal threaded part engaging with the external threaded part 210 formed on the outer circumference of the protrusion part 200 is formed on the inside of the body part 410.

The first spurting hole 420 protrudes from a surface of the body part 410, and has the same size as the diameter of the discharge hole 340 to communicate with the discharge hole.

That is, the first spurting hole 420 is formed to have the same size as the diameter of the discharge hole 340, thus communicating with the discharge hole 340. Such a first spurting hole 420 serves to spray the powder-type hair thickening agent onto a wide range.

The mesh net 430 is coupled to another surface of the body part 410, and serves to disperse the powder-type hair thickening agent spurted to the first spurting hole 420. In other words, the mesh net 430 disperses the powder-type hair thickening agent spurted through the discharge hole 340, thus spurting the hair thickening agent to the first spurting hole 420. Such a mesh net 430 prevents the powder-type hair thickening agent from agglomerating and disperses the hair thickening agent, thus allowing the hair thickening agent to be widely sprayed onto a desired region.

The main stopper 440 is detachably coupled to cover the body part 410. That is, the main stopper 440 is placed on the upper portion of the body part 410, and covers to seal the body part 410 or opens the body part.

The sub stopper 450 is installed inside the main stopper 440, and has a second spurting hole 460 that is formed to have a diameter smaller than an inner diameter of the first spurting hole 420 and communicates with the first spurting hole 420. Depending on the opening and closing method of the sub stopper 450, the spraying amount of the powder-type hair thickening agent may be adjusted.

The second spurting hole 460 protrudes from a center on an inner surface of the sub stopper 450, and is inserted into the inner circumference of the first spurting hole 420. Further, the second spurting hole 460 has the shape of a pipe that is formed to have a diameter smaller than that of the first spurting hole 420. As the second spurting hole is formed through the sub stopper 450, the first spurting hole 420 communicates with the sub stopper 450. Such a second spurting hole 460 has the diameter smaller than the inner diameter of the first spurting hole 420, thus serving to spray the powder-type hair thickening agent onto a narrow range.

Such a cap part 400 further includes a connecting part 470 and a hinge part 480 such that the main stopper 440 covers the body part 410 and the sub stopper 450 is detachably coupled to the first spurting hole 420.

The connecting part 470 is formed on a side of each of the body part 410 and the main stopper 440 to integrally connect the body part 410 with the main stopper 440, thus preventing the main stopper 440 from being lost from the body part 410.

The hinge part 480 is formed on a surface of the body part 410, and serves to rotate the sub stopper 450. Such a hinge part 480 is located adjacent to the connecting part 470, and includes a pair of walls 481 extending vertically from a surface of the body part 410 to be spaced apart from each other by a predetermined distance. Furthermore, a hinge shaft 482 is provided to be horizontally coupled with the pair of walls 481. Preferably, the pair of walls 481 is located inside of the inner diameter of the main stopper 440 so as not to be interfered by the main stopper 440.

Meanwhile, the sub stopper 450 has a coupling part 451 that has a groove formed on a side of the sub stopper 450 to be coupled to the hinge shaft 482. That is, the coupling part 451 is detachably coupled to the hinge shaft 482, thus guaranteeing easy replacement.

As such, the hinge part 480 serves to rotate the sub stopper 450 about the hinge shaft 482.

Further, in the powder-type hair thickening agent storage container 10 having the plurality of spurting holes according to the embodiment of the present invention, the container part 100 includes an air capsule 130 therein to remove moisture of the powder-type hair thickening agent.

The air capsule 130 has the shape of a ball formed in a predetermined size to be located in the container part 100. Further, the air capsule 130 contains a dehumidifying agent to remove the moisture that may be produced in the powder-type hair thickening agent.

Furthermore, if the container part 100 is turned upside down to discharge the powder-type hair thickening agent to the first and second spurting holes 420 and 460, the powder-type hair thickening agent moves towards the protrusion part 200 along with the air capsule 130, the air capsule 130 may prevent the powder-type hair thickening agent from agglomerating.

Hereinafter, the process of using the powder-type hair thickening agent storage container 10 having the plurality of spurting holes according to the embodiment of the present invention, which is configured as described above, will be described.

As shown in FIG. 5, if the main stopper 440 and the sub stopper 450 are separated from the body part 410 to open the body part, the first spurting hole 420 formed in the cap part 400 is exposed. Subsequently, as shown in FIG. 6, if a user holds the pressing surface 110 of the container part 100 with his or her fingers and then lightly presses the pressing surface 110, air pressure is generated in the container part 100 to move the powder-type hair thickening agent towards the protrusion part 200. Further, the powder-type hair thickening agent is dispersed through the pair of mesh filters 350 and then moves towards the discharge hole 340. At this time, the powder-type hair thickening agent is introduced into the discharge pipe 360 and then moves to the discharge hole 340. After the powder-type hair thickening agent is dispersed while passing through the mesh net 430, the hair thickening agent is spurted to the outside through the first spurting hole 420 to be sprayed onto a user's hair. Here, since the diameter of the first spurting hole 420 is formed large, the first spurting hole is useful when an area onto which the powder-type hair thickening agent is to be sprayed is wide.

Furthermore, as shown in FIG. 7, if the main stopper 440 is separated from the body part 410 to open the body part, the sub stopper 450 coupled with the first spurting hole 420 is exposed. Subsequently, as shown in FIG. 8, a user holds the pressing surfaces 110 of the container part 100 with his or her fingers, and lightly presses the pressing surfaces 110. In this case, air pressure is produced in the container part 100 to move the powder-type hair thickening agent stored in the container part towards the protrusion part 200. The powder-type hair thickening agent is dispersed while passing through the mesh net 430, and then is introduced into the first spurting hole 420. Thereafter, the hair thickening agent is spurted to the outside through the second spurting hole 460 communicating with the first spurting hole 420 to be sprayed onto a user's hair. Here, since the second spurting hole 460 is formed to be smaller in diameter than the first spurting hole 420, the second spurting hole is very useful when an area onto which the powder-type hair thickening agent is to be sprayed is narrow, like a part in his or her hair.

Thus, the powder-type hair thickening agent storage container 10 having the plurality of spurting holes according to the embodiment of the present invention is configured such that the first spurting hole 420 having the large inner diameter is selected and used when the powder-type hair thickening agent is widely sprayed onto the crown of the head, and the second spurting hole 460 having the small inner diameter is selected and used when the powder-type hair thickening agent is narrowly sprayed onto the part in the hair, thus affording convenience to a user.

Although the preferred embodiment of the present invention has been described herein, this is merely illustrative but is not intended to limit the present invention. Furthermore, it is apparent to those skilled in the art that various changes and modifications may be made without departing from the technical spirit of the invention.

Therefore, the present invention is not limited to the above-described embodiment but can be embodied in various ways without departing from the scope of the accompanying claims. Further, it will be understood by those of ordinary skill in the art that various changes and modifications may be made without departing from the spirit and scope of the present invention as defined by the appended claims.

The invention claimed is:

1. A powder-type hair thickening agent storage container having a plurality of spurting holes, the storage container having a cylindrical protrusion part which protrudes from an upper surface thereof to spurt a powder-type hair thickening agent to an outside, the storage container comprising:

a barrel-shaped container part storing the powder-type hair thickening agent therein;

a packing part detachably coupled to an inside of the protrusion part and having a discharge hole such that the powder-type hair thickening agent is spurted to the outside; and a cap part coupled to the protrusion part to surround the protrusion part, and adjusting a spurting amount of the powder-type hair thickening agent through the discharge hole, wherein the packing part comprises:

a column-shaped body part having a diameter corresponding to the inside of the protrusion part;

a step part protruding along an outer circumference of a top of the body part to be put on an upper end of the protrusion part;

a plurality of ring parts formed along an outer circumference of the body part to be in close contact with an inner circumference of the protrusion part;

a pair of mesh filters coupled to upper and lower portions in the discharge hole;

at least one discharge pipe vertically disposed in the discharge hole; and a thin film surrounding the discharge pipe.

2. The powder-type hair thickening agent storage container of claim 1, wherein the cap part comprises:

a body part having a shape of a pipe that is opened at a bottom thereof and is closed at a top thereof to correspond to a diameter of the outer circumference of the protrusion part;

a first spurting hole having a same size as a diameter of the discharge hole and protruding from a surface of the body part to communicate with the discharge hole;

a mesh net coupled to another surface of the body part to disperse the powder-type hair thickening agent spurted to the first spurting hole;

a main stopper detachably coupled to cover the body part; and a sub stopper installed inside the main stopper, and having a second spurting hole formed to have a diameter smaller than an inner diameter of the first spurting hole and to communicate with the first spurting hole, wherein the main stopper is detached or attached to open or close the second spurting hole.

3. The powder-type hair thickening agent storage container of claim 2, wherein the cap part comprises:

a connecting part formed on a side of each of the body part and the main stopper to integrally connect the body part with the main stopper; and a hinge part formed on a surface of the body part to rotate the sub stopper.

4. The powder-type hair thickening agent storage container of claim 1, wherein the container part comprises an air capsule therein to remove moisture of the powder-type hair thickening agent.

* * * * *